US011428102B2

(12) United States Patent
Rataj et al.

(10) Patent No.: US 11,428,102 B2
(45) Date of Patent: Aug. 30, 2022

(54) ROCK BOLT WITH INFORMATION DISPLAY REGION

(71) Applicants: SANDVIK MINING AND CONSTRUCTION AUSTRALIA (PRODUCTION/SUPPLY) PTY LTD, Milton (AU); SANDVIK MINING AND CONSTRUCTION TOOLS AB, Sandviken (SE)

(72) Inventors: Mieczyslaw Rataj, Heatherbrae (AU); Steven Weaver, Heatherbrae (AU); Bradley Darlington, Heatherbrae (AU); Peter Young, Pikenba (AU); Warren Roach, Pikenba (AU)

(73) Assignees: Sandvik Mining and Construction Australia (Production/Supply) Pty Ltd, Milton (AU); Sandvik Minina and Construction Tools AB, Sandviken (SE)

( * ) Notice: Subject to any disclaimer, the term of this patent is extended or adjusted under 35 U.S.C. 154(b) by 0 days.

(21) Appl. No.: 17/270,116

(22) PCT Filed: Aug. 20, 2019

(86) PCT No.: PCT/IB2019/056999
§ 371 (c)(1),
(2) Date: Feb. 22, 2021

(87) PCT Pub. No.: WO2020/039340
PCT Pub. Date: Feb. 27, 2020

(65) Prior Publication Data

US 2021/0172318 A1 Jun. 10, 2021

(30) Foreign Application Priority Data

Aug. 23, 2018 (EP) ..... 18190386

(51) Int. Cl.
*E21D 21/00* (2006.01)

(52) U.S. Cl.
CPC ..... *E21D 21/0026* (2013.01); *E21D 21/0093* (2013.01)

(58) Field of Classification Search
CPC ..... E21D 21/0026; E21D 21/008; E21D 21/0093; F16B 1/0071
See application file for complete search history.

(56) References Cited

U.S. PATENT DOCUMENTS 954,924 A * 4/1910 Brooks ..... G09F 7/18 40/668
1,787,154 A * 12/1930 Hughes ..... F16B 1/0071 411/429

(Continued)

FOREIGN PATENT DOCUMENTS

WO 2012126042 A1 9/2012

*Primary Examiner* — Benjamin F Fiorello
(74) *Attorney, Agent, or Firm* — Corinne R. Gorski

(57) ABSTRACT

A rock bolt arranged for installation within a bore formed in rock strata includes an elongate shaft with the leading end for installation into the bore and a trailing end projecting from an open end of the bore. A locking nut is threadably attached to the trailing end and is arranged to display product information and the like at a display face. The display face is recessed axially into the nut to provide protection against damage to the display face that may otherwise render the information unreadable.

12 Claims, 3 Drawing Sheets

(56) References Cited

U.S. PATENT DOCUMENTS

| | | | | | |
|---|---|---|---|---|---|
| 3,967,455 | A * | 7/1976 | Conway | E21D 21/0093 | 405/288 |
| 4,295,761 | A | 10/1981 | Hansen | | |
| 4,386,877 | A * | 6/1983 | McDowell, Jr. | E21D 21/008 | 405/259.5 |
| 4,595,315 | A * | 6/1986 | Gallagher, Jr. | E21D 21/0026 | 405/259.5 |
| 5,375,955 | A * | 12/1994 | Leslie | F16B 1/0071 | 411/378 |
| 6,073,552 | A * | 6/2000 | Cruse | F16B 1/0071 | 101/32 |
| 11,098,744 | B2 * | 8/2021 | Tamm | F16B 31/021 | |
| 2004/0067120 | A1 * | 4/2004 | Speer | F16B 1/0071 | 411/14 |
| 2011/0268526 | A1 * | 11/2011 | Wu | E21D 21/008 | 411/1 |
| 2011/0311319 | A1 * | 12/2011 | Spearing | E21D 21/008 | 405/302.2 |

* cited by examiner

ROCK BOLT WITH INFORMATION DISPLAY REGION

RELATED APPLICATION DATA

This application is a § 371 National Stage Application of PCT International Application No. PCT/IB2019/056999 filed Aug. 20, 2019 claiming priority to EP 18190386.5 filed Aug. 23, 2018.

FIELD OF INVENTION

The present invention relates to a rock bolt for installation within a bore formed in rock strata and in particular to a rock bolt with a nut having a recessed portion for displaying information.

BACKGROUND ART

Roof and wall support is vital in underground mining and tunnelling operations. Tunnel walls and roofs are typically formed from rock strata that requires reinforcement to prevent failure, fragmentation or collapse. Typically, a bore hole is formed in the rock strata by a drilling operation and then the rock bolt is installed into the as-formed bore where it is secured to provide reinforcement against major rock fracture and strata fragmentation.

Different forms of rock bolts have been developed including resin or cement grout bolts that are frictionally secured in the bore using a resin or grout introduced into the bore prior to the bolt which sets to lock the bolt into position. Mechanical friction rock bolts have expander mechanisms positioned towards a leading end that function to expand radially within the bore to prevent axial withdrawal. The trailing end of resin, grout and mechanical friction rock bolts typically project a short distance outside of the bore and remain visible. In some instances, the trailing end of the bolt is used for supporting ancillary fixtures such as containment meshing (via meshing plates), mining services utilities, pipes, cables etc. In some installations, the projecting end of the rock bolt can be threaded for connection of mechanical fixtures.

A locking nut at the trailing end of the rock bolt may be a blind nut which in the case of a mechanical friction bolt is configured to engage the rearward end of the bar such that further rotation of the nut provides a corresponding rotation of the bolt shaft to provide installation via a translated expansion of the expander mechanism. Typically, product information is stamped on an external exposed face of the locking nut that may include an alphanumeric code for material traceability, bolt ID etc. However, this exposed face is often damaged by the bolt installation driver tool as the bolt is hammered into the bore. Accordingly, such stamped information often becomes unreadable.

SUMMARY OF THE INVENTION

It is an objective of the present invention to provide a rock bolt configured to display information that is prevented from damage during bolt installation into a receiving bore hole in the rock strata so as to preserve the information to be capable of being displayed after bolt installation.

It is a specific objective to provide a locking nut for a rock bolt adapted to carry relevant information such as bolt identification (ID), material traceability information, manufacturer information, rock bolt type information, codes, logos, trademarks and other indicia to be visible to personnel within a mine tunnel where a rock bolt is installed for example in a wall or roof.

The objectives are achieved by providing a rock bolt having an axially rearward nut attached to an elongate shaft of the bolt with the nut having a recessed portion that in turn provides a display face that is axially recessed relative to an axially rearwardmost exposed face of the nut. As the display face is recessed axially (relative to the rearward exposed face), the display face is protected from the bolt driver tool and in particular the driver socket that is typically positioned over and about the nut to deliver the percussive hammering action.

Conventionally, bolt driver tools and in particular driver sockets are at least part tubular having a cylindrical inner cavity. Optionally, the nut of the rock bolt of the present invention is provided with a recessed portion having a diameter that is approximately equal to or less than a diameter of the internal cylindrical cavity of the driver socket such that no part of the driver socket is positioned in contact with or extends over the recessed portion and in particular the axially recessed display face. According to a preferred implementation, the recessed portion and the recessed display face are positioned centrally at a rearward facing exposed face of the nut with the exposed face being annular to extend around the recessed portion and the display face. In such an implementation, the driver socket and in particular an abutment contact area of the driver socket is adapted to sit into contact with the annular exposed face and not to overlay onto the recessed portion.

According to a first aspect of the present invention there is provided a rock bolt for installation within a bore formed in rock strata comprising: an elongate shaft having a leading end for installation into the bore and a threaded trailing end to project from an open end of the bore; an internally threaded nut attached at the trailing end to mount a rock plate against a surface of the rock strata, the nut having an axially forward facing contact face for positioning opposed to the rock plate and an axially rearward facing exposed face; characterised by: a recessed portion extending axially inward from the exposed face and defining an axially rearward facing display face being axially recessed relative to the exposed face.

Optionally, the nut is a blind or semi-blind nut optionally when used within a mechanical friction bolt system. Optionally, the nut may be non-blind to comprise a through-bore internally threaded between a first and second axial end, for example within a resin or cement grouted bolt system. The thread may extend completely or partially the axial length of the nut.

Optionally, the exposed face is annular and the display face is positioned centrally and surrounded by the exposed face. Optionally, the nut is semi-blind, the display face is annular and extends around a central opening into an internal threaded cavity of the nut. Optionally, the nut may be semi-blind and comprise a non-circular recess wall. Where the nut is fully blind, the display face may be circular, polygonal and in particular hexagonal or heptagonal.

Optionally, the bolt further comprises a tab mounted within the recessed portion and having an axially rearward facing tab display face. The tab may be disc-shaped, or at least part disc-shaped. Optionally, the tab may be generally planar or may be mushroom-shaped having a forward and a rearward facing face. The tab may comprise indicia provided at each of the forward and rearward faces. Accordingly, the tab may be positioned in two different orientations within the recessed portion. Optionally, the tab may be non-circular (e.g., hexagonal). Optionally, the tab may be non-planar and may comprise a head part and a shaft extending from the head. Preferably, the shaft is capable of locating within an opening of a semi-blind nut.

Preferably, the bolt further comprises indicia provided at the display face. The indicia at the display face of the nut may be additional to any indicia provided at the tab display face(s). Accordingly, the information at the display face of the nut may be the same or different to the information provided on the display face(s) of the tab.

Optionally, an outside surface of the nut comprises a polygonal, square or hexagonal cross sectional profile. Such a configuration provides a nut that is conveniently engageable and drivable by conventional bolt drive apparatus having an engaging driver socket.

Preferably, the nut comprises threads at the outside surface. This is beneficial for attachment of auxiliary fixtures to the nut with such auxiliary fixtures having an internally threaded socket for the threading onto the outside surface of the nut.

Optionally, the recessed portion comprises an undercut such that a diameter of the recessed portion increases in an axial direction from the exposed face. Optionally, the recessed portion may be provided with an adhesive, crimping, weld or at least one radial projection extending radially to overlay at least a portion of the tab. Optionally, where the recessed portion comprises an undercut, the tab may be secured within the recessed portion by abutment underneath the undercut. Optionally, the recessed portion may be threaded such that the tab may be screwed into the recessed portion via a suitable forked tool or other engagement tool.

Preferably, an axial thickness of the tab is less than an axial depth of the recessed portion. In particular, a thickness of the tab is less than a minimum axial depth of the recess portion, where the recessed portion depth is non-uniform at the nut. Optionally, a distance by which the display face is recessed axially relative to the exposed face is less than a radial wall thickness of the nut. Optionally, said distance is less than a thickness of an end wall of a semi-blind or fully blind nut.

Optionally, the rock bolt may be a resin, cement grouted or mechanical friction bolt or any other bolt with a nut.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

The present locking nut is suitable for use with a variety of different types of rock bolt including resin, cement grout and mechanical friction rock bolts where the nut is attachable via cooperating screw threads to a trailing end of an elongate shaft of the rock bolt. The present locking nut according to its use with different types of rock bolt, may be used to actuate an expander mechanism within a mechanical friction rock bolt and/or to secure a rock or meshing plate against the rock strata at the region around the bore hole within which the rock bolt is mounted. According to all the implementations, the present locking nut is internally threaded and adapted for releasable securing onto the threaded trailing end of an elongate shaft extending through the rock bolt.

Figure 1:
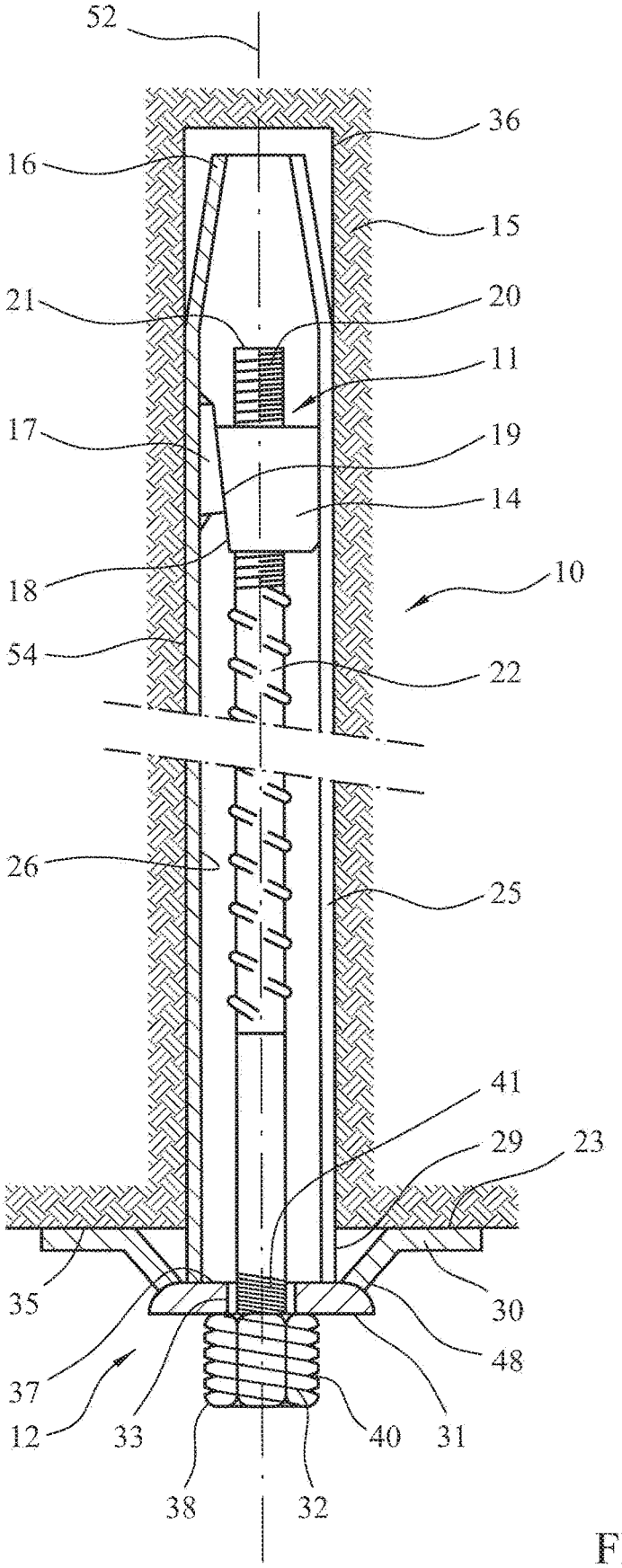
FIG. 1 is a partial cross sectional view of a mechanical friction rock bolt assembly configured for anchored mounting within a bore formed within rock strata according to a specific implementation of the present invention.

For the purposes of describing the aspects of the present invention, a locking nut configured for the display of information is described with reference to a mechanical friction bolt. In particular, and referring to FIG. 1, a friction rock bolt assembly 10 is configured for mounting and securement within a bore 36 extending within a rock strata 15. The friction bolt 10 is generally elongate being centred on longitudinal axis 52 and comprises primarily an elongate tube 25 that is split axially; an expander mechanism indicated generally by reference 11; and an anchor mechanism indicated generally by reference 12. Expander mechanism 11 is mounted towards a leading end 16 of tube 25 whilst anchor mechanism 12 is positioned towards a trailing end 41 of tube 25. In particular, anchor mechanism 12 projects rearwardly from tube 25 and is positioned at and extends from an open end of bore 36 adjacent a surface 35 of the rock strata 15 that surrounds the bore open end.

Expander mechanism 11 may be formed from a pair of cooperating wedges 14, 17. A first wedge 14 is formed generally as a collar having an internal bore with radially inwardly facing threads to engage and cooperate with corresponding threads 20 provided at a first leading end 21 of an elongate bar 22 that extends axially through tube 25 from tube trailing end 41 to tube leading end 16. First wedge 14 is accordingly axially adjustable at bar 22 via the respective threads. Second wedge 17 is mounted rigidly to an internal facing surface 26 of tube 25 at a position towards tube leading end 16. The first and second wedges 14, 17 each comprise a respective engaging surface 18, 19 aligned transverse to axis 52. Accordingly, by linear axial adjustment of first wedge 14 along bar 22, engaging surface 18 of first wedge 14 abuts engaging surface 19 of second wedge 17 so as to force the first wedge 14 radially outward from axis 52 and against tube internal surface 26. The radial expansion of expander mechanism 11 acts to force and deform tube 25 radially outward against the internal facing surface of bore 36 to lock the friction bolt assembly 10 within the bore 36.

Linear axial movement of first wedge 14 is provided by anchor mechanism 12 that comprises an internally threaded nut 32 mounted to a second trailing end 40 of bar 22. Accordingly, rotation of nut 32 about axis 52 provides a corresponding rotation of bar 22 that, in turn, pulls the first wedge 14 towards tube trailing end 41 (via threads 20) to provide the radial expansion force. Anchor mechanism 12 further comprises a washer 31 (alternatively termed a gasket) having a central aperture 33 to sit about and around bar 22 at trailing end 40. Gasket 31 is formed non-integrally with nut 32, tube 25 and other components of the bolt assembly 10 so as to be an independent component. Gasket 31 projects radially outward from bar 22 and tube 25 such that an abutment surface 37 that is orientated generally axially towards tube leading end 16 extends radially outward beyond a radially external facing surface 54 of tube 25. Gasket 31 and surface 37 extend radially outward beyond tube external surface 54 by a distance that is approximately equal to or greater than a corresponding radial distance by which gasket 31 projects radially inward from tube internal surface 26 towards bar 22 that is centred on axis 52. As will be appreciated, the distance by the gasket 31 extends radially beyond the tube wall may be varied and selected to suit specific applications. Accordingly, gasket 31 provides a radially outward extending flange at the tube trailing end 41 and bar trailing end 40. Gasket 31 accordingly projects radially outward beyond the diameter of bore 36 (formed within the rock strata 15) such that at least a radial outer region of abutment surface 37 is capable of being braced, either directly or indirectly, against the rock strata surface 35 that surrounds radially the bore open end.

According to the specific implementation, the friction rock bolt assembly 10 comprises a rock plate indicated generally by reference 30 that is formed as a profiled generally annular gasket having a radially outer portion and a corresponding radially inner portion. The radially outer portion comprises a generally annular (or in other instances rectangular) abutment surface 23 configured to sit against the rock strata surface 35 whilst the inner portion terminates as an annular edge 48 that defines a central hole having a diameter slightly greater than a diameter of tube 25 but less than a corresponding diameter of gasket 31. In particular, the radially inner edge 48 of rock plate 30 is configured to abut gasket surface 37 such that gasket 31 is braced against the rock strata surface 35 via rock plate 30. Accordingly, gasket 31 projects radially outward from tube 25 to provide an appropriate radial overlap between the radially inner portion of rock plate 30 and a radially outer portion of gasket 31 in turn allowing gasket 31 to be braced against rock plate 30 which is, in turn, braced against rock strata surface 35 either directly or via an intermediate meshing sheet (not shown) to provide containment of the rock strata at a tunnel wall or roof. Tube trailing end 41 according to the specific implementation, is devoid of a ring or collar (not shown) positioned externally at tube external surface 54. Such a ring or collar may be welded to trailing end 41 to provide a region of abutted mating with the radially inner edge 48 of rock plate 30. According to further embodiments, gasket 31 may be configured to sit directly against the rock strata 15 via respective abutment between abutment surface 37 and rock surface 35.

Figure 2:
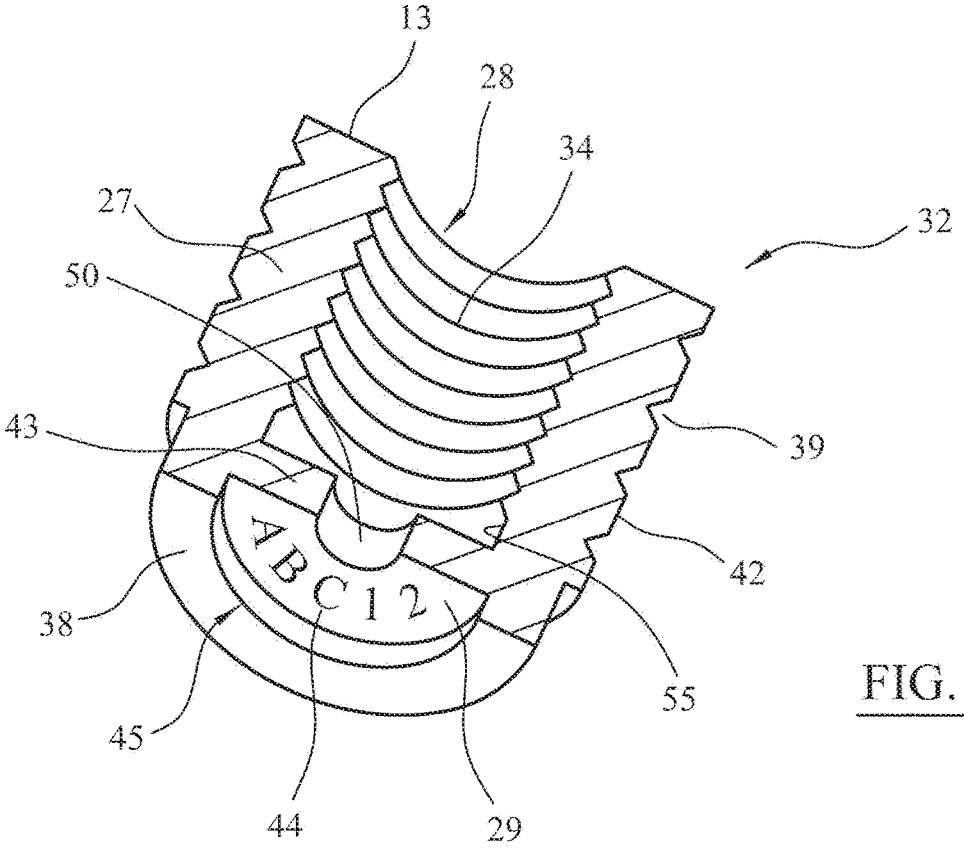
FIG. 2 is a cross sectional perspective view of a locking nut secured at a trailing end of the rock bolt of FIG. 1 according to the specific implementation of the present invention.

Referring to FIG. 2, nut 32 comprises an outside surface 42 having a polygonal and in particular hexagonal cross sectional profile. Threads 39 are provided at outer surface 42 so as to provide mounting of auxiliary fixings to nut 32 either before or once bolt 10 is mounted and secured in position within bore 36. Nut 32 comprises a generally cylindrical internal cavity 28 defined by a radially inward facing inner surface 55 onto which threads 34 are formed. Threads 34 extend substantially the full axial length of nut 32 between an axially forward facing annular contact face 13 and a semi-blind innermost end of cavity 28 defined by an end wall 43. An opening 50 is formed within end wall 43. However, according to further implementations, end wall 43 may be solid across the full diameter so as to define a fully blind nut 32. An axially rearward end of nut 32 is defined by an axially rearward facing annular exposed face 38 that represents an axial end of nut wall 27 that define internal cavity 28. The rearward end of nut 32 is further defined by end wall 43 and opening 50.

According to the specific implementation, a recessed portion indicated generally by reference 45 is provided at the axially rearward end of nut 32 at the region of end wall 43. In particular, the central region of exposed face 38 is recessed axially inward such that a display face 29 (that represents an axially rearward facing surface of end wall 43) is recessed axially relative to exposed face 38. Display face 29 is annular to surround circular opening 50 and is in turn surrounded by the annular exposed face 38. According to the specific implementation, an axial distance by which display face 29 is recessed axially relative to exposed face 38 is less than a thickness of nut wall 27 and in particular is less than 50%, 40%, 30% of the wall thickness and may be in the range 5 to 30% or 5 to 20% of a thickness of nut wall 27.

Figure 4:
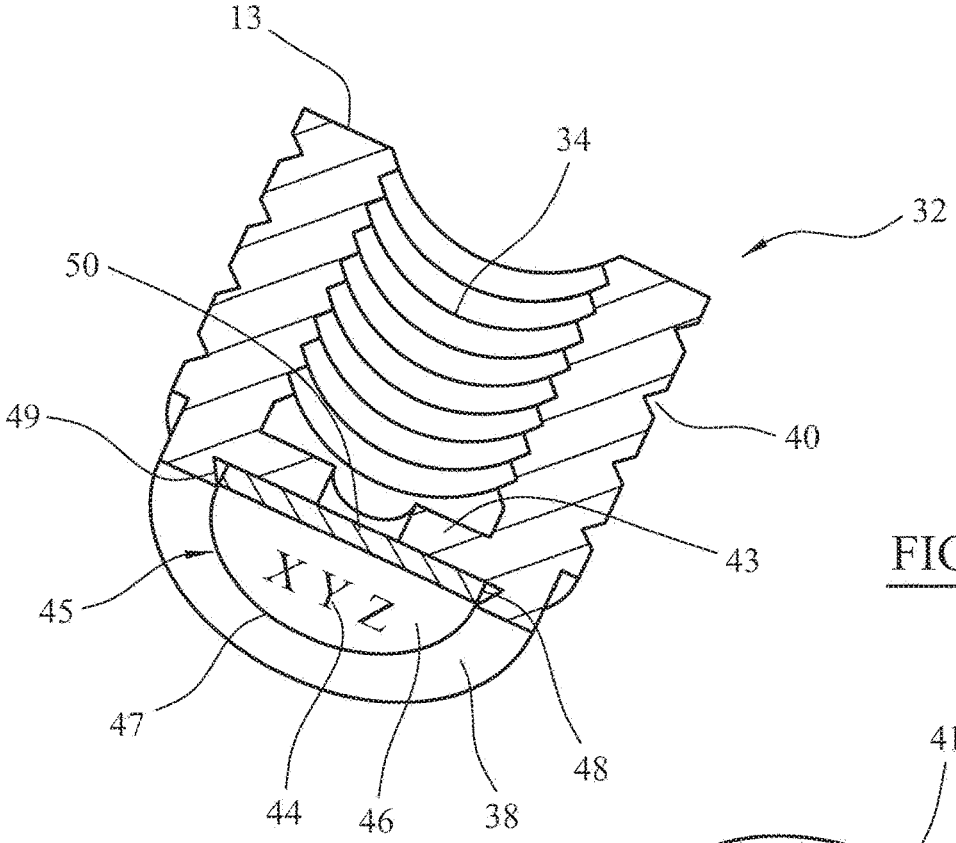
FIG. 4 is a cross sectional perspective view of a further specific implementation of a locking nut securable to the trailing end of the rock bolt of FIG. 1.

Referring to FIG. 4, recessed portion 45 may be formed with an undercut 49 such that a diameter of the recess from exposed face 38 increases in the axial direction from exposed face 38 towards end wall 43. According to the embodiments of FIGS. 2 and 4, a display tab 47 having a disc-like configuration is capable of being mounted within recessed portion 45. According to the embodiment of FIG. 4, tab 47 may be secured by abutment contact underneath the undercut 49 that forms a securing lip around the perimeter of tab 47.

Accordingly, tab 47 may be formed from a resiliently deformable and/or flexible material such as a metal or a polymer. Accordingly, tab 47 is secured in position by frictional contact between undercut 49 and wall 43 and is positioned in contact with and overlaying display face 29 (FIG. 2). A thickness of tab 47 is less than the axial depth of recessed portion 45 such that tab display face 46 is aligned coplanar or preferably is recessed relative to exposed face 38.

The recessed display face 29 at end wall 43 is capable of displaying information relative to the rock bolt 10, the region of installation, the manufacturer of the components described herein, the installer or other relevant information including materials, dates, product codes, logos, trademarks etc. In particular, display face 29 is capable of displaying indicia that may be marked, printed, etched, stamped or in other ways adhered to face 29. As will be appreciated, the same or similar information may be provided at tab display face 46 with such information being additional or alternative to the information displayed at end wall display face 29.

Figure 5:
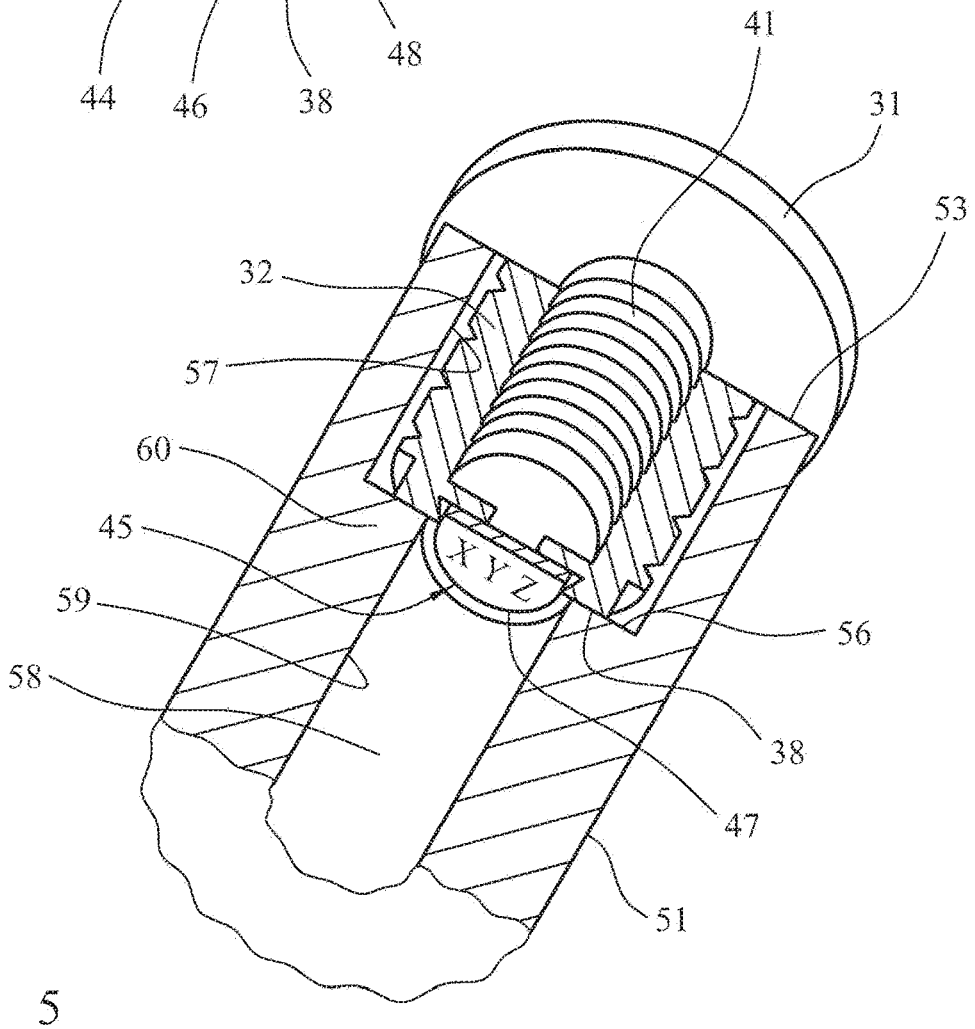
FIG. 5 is a cross sectional perspective view of a bolt driver socket positioned in contact with the locking nut of FIG. 4 to provide percussive driving of the rock bolt of FIG. 1 into a bore hole.

The present arrangement of nut 32 is advantageous as detailed with referent to FIG. 5 by avoiding damage to the display faces 29, 46 by a bolt driver tool and in particular driver socket 51 that is brought into contact with nut 32 for percussive hammering of the rock bolt 10 into the bore 36. In particular, driver socket 51 comprises an annular leading end face 53 for abutment contact against gasket 31. An internal cavity 57 extends axially from end face 53. A shoulder 60 projects radially inward at an axially inner end of cavity 57 to define an annular cavity end face 56. A generally cylindrical bore 58 extends axially rearward from cavity end face 56 and is defined by a radially inward facing surface 59. Preferably, a diameter of recessed portion 45 and in particular display face 29 is approximately equal to or less than a diameter of driver socket bore 58 such that no part of driver socket 51 is capable of abutment contact with display face 29 of wall 43 and/or tab display face 46. As will be appreciated, driver socket 51 may vary in design and may not include central bore 58 such that cavity end face 56 is circular and is capable of being brought into full abutment contact against the rearward facing end face of nut 32. Via the recessed portion 45, driver socket end face 56 abuts only the exposed face 38 so as to protect and preserve the information (indicia) 44 provided at the respective display faces 29, 46.

Figure 3:
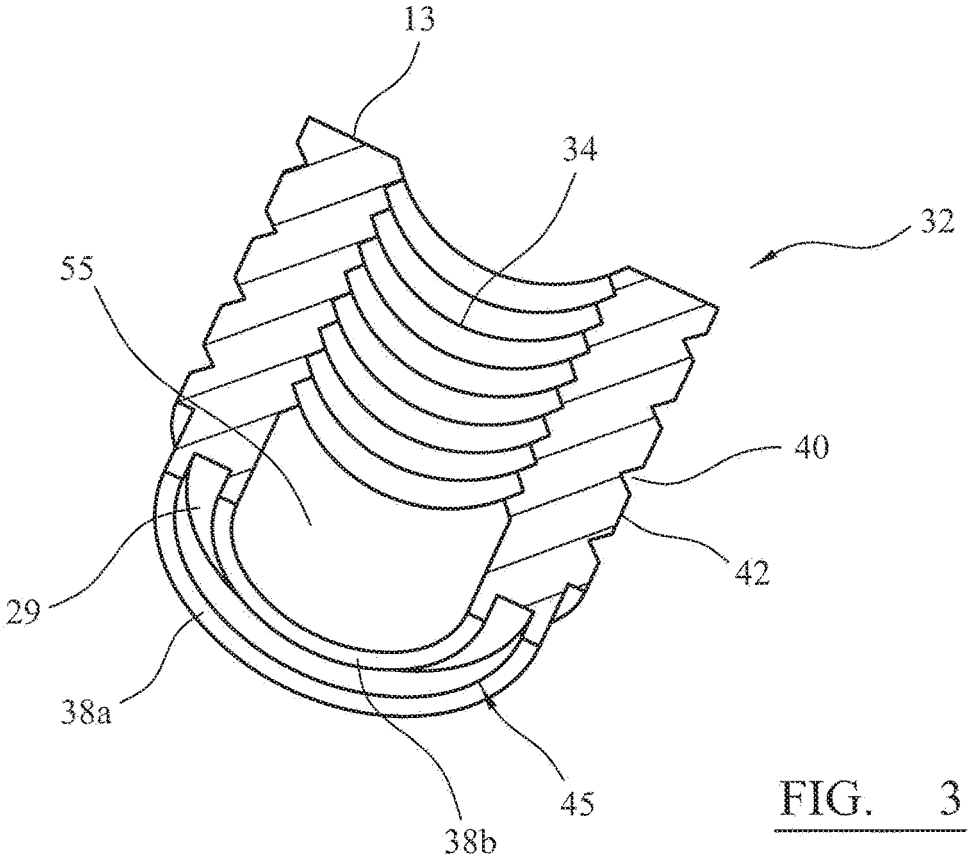
FIG. 3 is a cross sectional perspective view of a locking nut according to a further specific implementation of the present invention securable to the trailing end of the rock bolt of FIG. 1.

A further embodiment of the present invention is described referring to FIG. 3 in which nut 32 is not blind or semi-blind and that internal cavity 28 (of FIG. 2) extends the full axial length of nut 32 between contact face 13 and the axially rearwardmost exposed face 38. According to this further embodiment, recessed portion 45 is annular and is recessed into exposed face 38 as an annular channel or groove so as to radially divide exposed face 38 into an annular inner face 38*b* and an annular outer face 38*a*. Information 44 (not shown in the embodiment of FIG. 3) is provided at the display face 29 as described referring to FIG. 2. Additionally, an annular tab 46 of the type described referring to FIG. 4 may be mounted within the annular recessed portion 45 via the optional anchorage mechanisms described referring to the embodiment of FIG. 4. As will be appreciated, important aspects of all embodiments of the present invention are that display face 29 is recessed axially relative to an axially rearwardmost exposed face 38, 38*a*, 38*b* so as to avoid damaging abutment contact with driver socket end face 56. This recessed arrangement further protects and preserves the displayed information from damage by the attachment of auxiliary fixtures such as rock plates, mining services, pipes, cables, eyelets, meshing plates fixings etc.

The invention claimed is:

1. A rock bolt arranged for installation within a bore formed in rock strata, the rock bolt comprising:

an elongate shaft having a leading end for installation into the bore and a threaded trailing end arranged to project from an open end of the bore;

an internally threaded nut attached at the trailing end arranged to mount a rock plate against a surface of the rock strata, the nut having an axially forward facing contact face arranged for positioning opposed to the rock plate and an axially rearward facing exposed face;

a recessed portion extending axially inward from the exposed face and defining an axially rearward facing display face being axially recessed relative to the exposed face; and a tab mounted within the recessed portion and having an axially rearward facing tab display face.

2. The rock bolt as claimed in claim 1, wherein the nut is a blind or semi-blind nut.

3. The rock bolt as claimed in claim 1, wherein the exposed fac is annular and the display face is positioned centrally and surrounded by the exposed face.

4. The rock bolt as claimed in claim 3, wherein the nut is semi-blind and the display face is annular and extends around a central opening into an internal threaded cavity of the nut.

5. The rock bolt as claimed in claim 1, wherein the recessed portion includes an undercut such that a diameter of the recess portion increases in an axial direction from the exposed face.

6. The rock bolt as claimed in claim 5, wherein the tab includes an axially rearward facing tab display face, wherein the tab is secured within the recessed portion by abutment underneath the undercut.

7. The rock bolt as claimed in claim 1, wherein the tab has an axial thickness less than an axial depth of the recessed portion.

8. The rock bolt as claimed in claim 1, wherein the tab is secured within the recessed portion by an adhesive, crimping, weld or at least one radial projection extending radially to overlay at least a portion of the tab.

9. The rock bolt as claimed in claim 1, wherein a distance by which the display face is recessed axially relative to the exposed face is less than a radial wall thickness of the nut.

10. The rock bolt as claimed in claim 9, wherein the distance by which the display face is recessed axially relative to the exposed face is less than half a radial wall thickness of the nut.

11. The rock bolt as claimed in claim 1, comprising a resin, cement grouted or mechanical friction bolt.

12. The rock bolt as claimed in claim 1, further comprising indicia provided on the display face.

* * * * *